United States Patent [19]

Rasmussen

[11] Patent Number: 4,476,608

[45] Date of Patent: Oct. 16, 1984

[54] APPARATUS FOR REMOVAL OF ASH

[75] Inventor: Ib R. Rasmussen, Randers, Denmark

[73] Assignee: P.I.A. Textiles A/S, Odense, Denmark

[21] Appl. No.: 411,474

[22] Filed: Aug. 25, 1982

[51] Int. Cl.[3] ..... A47L 9/16

[52] U.S. Cl. ..... 15/353; 15/352; 55/458; 55/459 A

[58] Field of Search ..... 15/353, 352; 55/458, 55/459 R, 459 A, 459 C

[56] References Cited

U.S. PATENT DOCUMENTS

| | | | |
|---|---|---|---|
| 2,867,231 | 1/1959 | Gerstmann | 15/353 X |
| 3,029,463 | 4/1962 | Bishop | 15/353 |
| 3,490,208 | 1/1970 | Meyer et al. | 15/353 X |
| 4,041,569 | 8/1977 | Petersen | 15/353 |
| 4,179,769 | 12/1979 | Lundquist | 15/353 |
| 4,246,676 | 1/1981 | Hallsworth et al. | 15/353 |

*Primary Examiner*—Chris K. Moore

[57] ABSTRACT

Apparatus for removal of ash and the like from open fireplaces, ashpans etc. by means of a vacuum cleaner, said apparatus comprising an airtight ash container, an inlet pipe stub for ash and air and an outlet pipe stub to be connected with a suction source such as a vacuum cleaner, wherein the container comprises a barrel with a bottom and an easily mountable and dismountable cover or lid and wherein the lid or cover carries the inlet pipe stub and the outlet pipe stub.

5 Claims, 9 Drawing Figures

APPARATUS FOR REMOVAL OF ASH

This invention relates to an apparatus for removal of ash from open fireplaces, ashpans and the like by means of a vacuum cleaner.

One of the objects of the present invention is to provide an apparatus for preventing damage to the vacuum cleaner hose or the vacuum cleaner per se since said hose and vacuum cleaner normally are unable to resist the influence of ash and possible live coals or embers in the ash.

A further object is to minimize the extent of special manufactured components in the apparatus.

A still further object is to provide such an apparatus in which an ash filter is not necessary.

Hitherto known apparatuses of this kind have one or more of the following disadvantages. Complicated and therefore expensive construction, uneasy to use, to empty, to clean or carry, and high energy consumption because of a high flow resistance.

The above and further objects and novel features of the present invention will be apparent from the description set forth below when read with the accompanying drawings, the latter being for purposes of illustration only and not defining the limits to the invention, reference for this latter purpose being made to the appended claims.

Figure 1:
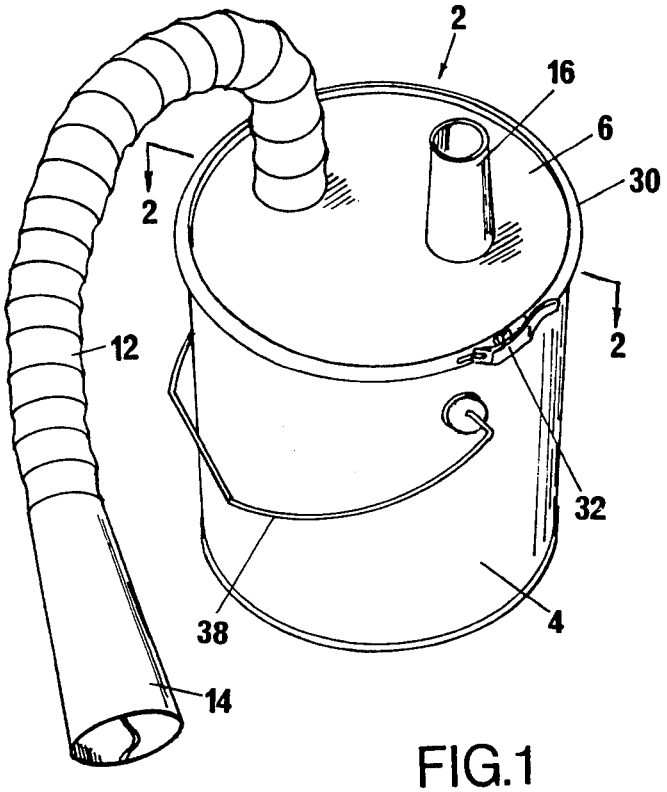
FIG. 1 is a perspective view of a known apparatus.
Figure 2:
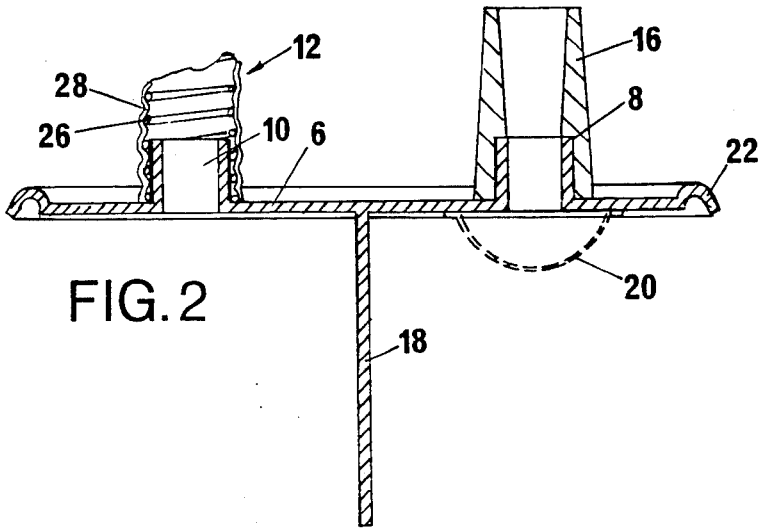
FIG. 2 is a vertical sectional view of the cover of the apparatus taken substantially on line 2—2 of FIG. 1.

Referring to the drawings, and in particular to FIG. 1, one form of the known apparatus 2 is shown comprising an ash container in the form of a barrel 4, a lid or cover 6 having an outlet pipe stub 8 to be connected to a suction source e.g. the suction hose of a vacuum cleaner, and an inlet pipe stub 10 as shown in FIG. 2 connected to an ash suction hose 12 having an ash suction metal or steel mouthpiece 14 at its free end. The outlet pipe stub 8 carries an adaptor piece 16, e.g. of rubber, and which fits airtight to the outlet pipe stub 8 with its lower end and has an upper end being outside and inside conically shaped to fit most common vacuum cleaner hose end mouth pieces inside or outside.

As shown in FIG. 2 a partition plate 18 is mounted across the inner side of the cover 6 and having a width corresponding to the internal diameter of the barrel 4.

At the inner side of the cover 6 below the outlet pipe stub 8 a metal sieve or strainer 20 may be mounted which permits air but not larger particles to escape from the interior of the barrel.

The rim 22 of the cover 6 is provided with an annular depression for receiving the upper edge 24 of the barrel 4.

The plate 18 and the strainer 20 are preferably fastened to the cover 6 in depressions (not shown) which also will act to strengthen and stiffen the cover 6 when it is made of thin plate material.

The ash suction hose 12 is flexible and preferably made of fireproof material. The hose 12 shown in FIG. 2 comprises a spiral spring 26 for supporting the airtight and probably also fireproof encasing material 28 that may be winded or coiled airtight onto the spiral spring 26, which also acts to fasten the hose 12 onto the pipe stub 10.

Figure 3:
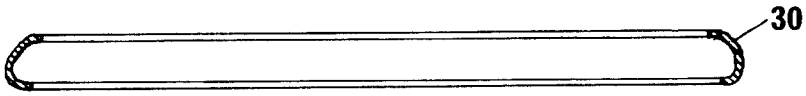
FIG. 3 is a sectional view of the lock ring for retaining the cover on the barrel taken along the line 2—2 of FIG. 1.

In FIGS. 1 and 3 a clamp means is shown in the form of a lock ring 30 having a C-formed cross section and a snap-action lock mechanism 32. The inner side of the ring 30 is complementary to the outer parts of the cover rim 22 and the barrel edge 24 when the last mentioned is inserted in the shown depression of the cover rim 22.

Figure 4:
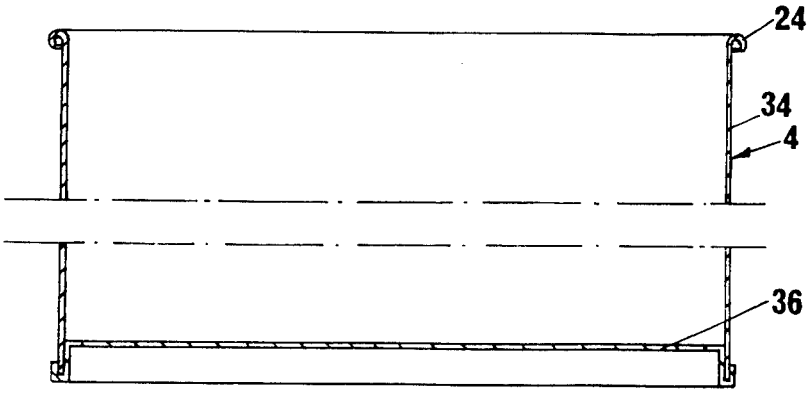
FIG. 4 is a sectional view of the barrel taken along the line 2—2 of FIG. 1.

In FIG. 4 the barrel 4 is shown in the form of a commonly used large cylindrical paint pot of metal or sheet metal, the interior height of which from its edge 24 along its jacket or mantel 34 to its bottom 36 is larger than the diameter of the barrel and, of course, then the length of the plate 18.

FIGS. 5, 6, 7, and 8 show an embodiment according to the invention of the cover 46 on which the inlet pipe stub 50 has a lower or interior end 42 protruding into the barrel (not shown) to impart a rotation of the inlet air along the interior wall of the barrel. The outlet pipe stub 48 is placed centrally to suck air from the center zone of the barrel, possibly through a strainer 52.

Figure 7:
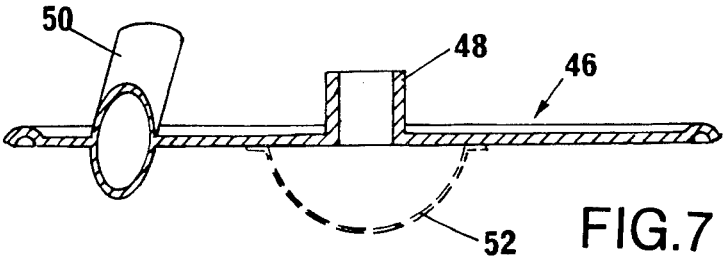
FIG. 7 is a sectional view taken substantially along line 7—7 of FIG. 5.
Figure 8:
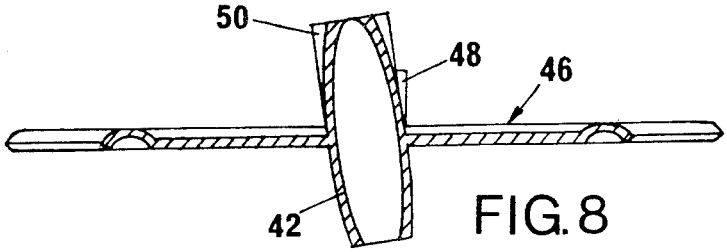
FIG. 8 is a sectional view taken substantially along line 8—8 of FIG. 5.

In the shown preferred embodiment of FIGS. 5–8 the inlet pipe stub 50, 42 is inclined to the plane of the cover 46 as shown in FIG. 8 approximately 60°. This inclination depends on the suction power through the outlet pipe stub 48 and consequently, the velocity of the air and particles through the inlet pipe stub 50. By large velocities the inclination may be close to 90°, e.g. 85° or 95° to 150°; the lower velocities, the closer to 30° or 150°.

Figure 5:
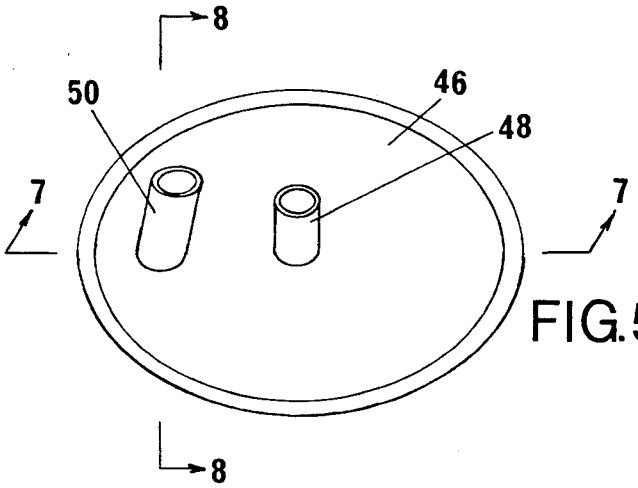
FIG. 5 is a perspective view of an embodiment of the cover seen from above with central outlet tube.
Figure 6:
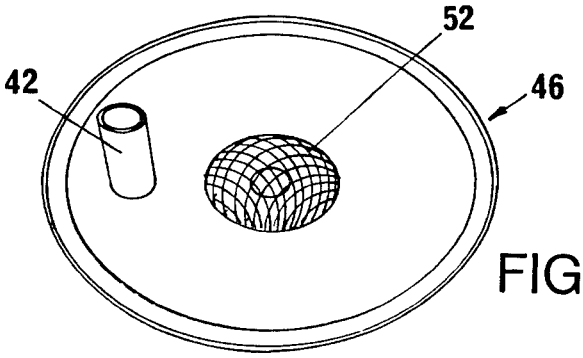
FIG. 6 is the embodiment of FIG. 5 seen from below.

As it appears from FIG. 5 and especially FIG. 7, the inclination of the inlet pipe stub 50 may also be so that its components is not only in the axial direction of the barrel or the cover but also in the radial direction. Thereby the air and ash sucked into the barrel through inlet pipe stub 50 will contact the inner wall of the barrel closer to the pipe stub 50, and a higher rotation speed of the ash mixture in the barrel will occur in consequence of which the air through outlet pipe stub 48 will contain even less particles, if any at all. At large suction power and accordingly high rotation rates the strainer 52 will be superfluous.

Figure 9:
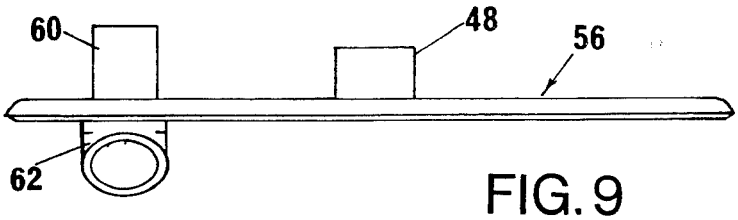
FIG. 9 is a side view of a further embodiment of the cover of the apparatus.

In FIG. 9 a cover 56 is shown corresponding to the cover shown in FIGS. 5–8, but provided with a vertical inlet pipe stub 60 at the lower part of which an elbow piece 62 is fitted. The free end of the elbow piece 62 is directed to the inner side of the barrel mantel or jacket so that the flow of air and ash sucked in through the elbow piece 62 strikes said inner side by an angle between 10° and 80°. The elbow piece may be in a fixed position as shown, but may also be fitted turnable around the inlet pipe stub 60. Thereby the inlet flow direction may be adjusted to the suction power in order to minimize the content of particles in the air sucked out through the outlet pipe stub 48. The elbow piece 62 may be a 90°, 120°, 150° or a 175° elbow, made of metal, cast iron or plastic.

When the elbow piece 62 is turned directly against the inner side of the barrel or directly away from it there will be no rotation of the inlet flow in the barrel which is an undesired ash removal condition. To avoid this the elbow piece 62 and the interior end of the inlet pipe stub 60 can be fitted with mutually cooperating stop means that do not allow said condition. These stop means may be one or two radially outwardly directed protrusions on the lower part of the stub 60 each in engagement with an inside groove along 90° of the inner periphery of the fitted end of the elbow piece 62.

The embodiment of this apparatus according to the invention has a relatively low flow resistance and therefore also a lower energy consumption.

What is claimed is:

1. An apparatus for removal of ash and the like from open fireplaces or ashpans by means of a vacuum cleaner, said apparatus comprising an airtight ash container, an inlet pipe stub for ash and air and an outlet pipe stub connectable with a suction source, the container comprising a cylindrical barrel with a bottom and an easily mountable and dismountable circular cover carrying the inlet pipe stub and the outlet pipe stub, wherein the outlet pipe stub is perpendicular to the cover in its center zone and the inlet pipe stub is positioned in the peripheral zone of the cover and inclined toward the center of the cover to form an angle with the plane of the cover in the range of from 30 to 85 degrees as indicated by the power of the suction source.

2. The apparatus according to claim 1 wherein the angle of inclination is 60 degrees.

3. The apparatus according to claim 1 is also inclined at an angle of from 30 to 85 degrees along a chord of the plane of the cover.

4. An apparatus for removal of ash and the like from open fireplaces or ash pans by means of a vacuum cleaner, said apparatus comprising an airtight ash container, an inlet pipe stub for ash and air and an outlet pipe stub connectable with a suction source, the container comprising a cylindrical barrel with a bottom and an easily mountable and dismountable circular cover carrying the inlet pipe stub and the outlet pipe stub, wherein the outlet pipe stub is perpendicular to the cover in its center zone and the inlet pipe stub is positioned in the peripheral zone of the cover, the lower portion of the inlet pipe stub carries an elbow element having an elbow angle in the range of from 90 to 175 degrees, the free end of the elbow element being directed at the inner surface of the barrel at an angle of from 10 to 80 degrees with the radially outwardly adjacent barrel surface, said pipe stub being perpendicular to the cover plane.

5. The apparatus according to claim 4 wherein said elbow element is pivotable about said inlet pipe stub lower portion and said elbow element and said lower portion carry mutually cooperating means to limit said angle with the radially outwardly adjacent inner surface of said barrel to said 10 to 80 degrees.

* * * * *